US008858295B2

(12) United States Patent
Thompson

(10) Patent No.: US 8,858,295 B2
(45) Date of Patent: Oct. 14, 2014

(54) MAMMOGRAPHY BRASSIERE

(76) Inventor: Elizabeth Chabner Thompson, Scarsdale, NY (US)

( * ) Notice: Subject to any disclaimer, the term of this patent is extended or adjusted under 35 U.S.C. 154(b) by 227 days.

(21) Appl. No.: 13/477,983

(22) Filed: May 22, 2012

(65) Prior Publication Data

US 2013/0316616 A1 Nov. 28, 2013

(51) Int. Cl.
*A41C 3/00* (2006.01)
*A41C 1/06* (2006.01)

(52) U.S. Cl.
USPC ..... 450/62; 450/8; 450/9; 450/10

(58) Field of Classification Search
USPC ..... 450/7–10, 58, 59, 62, 66, 70, 74–72; 2/67
See application file for complete search history.

(56) References Cited

U.S. PATENT DOCUMENTS

| | | | | |
|---|---|---|---|---|
| 3,465,754 | A * | 9/1969 | Lockwood et al. | 450/1 |
| 3,740,765 | A * | 6/1973 | Delplace | 2/67 |
| 4,444,191 | A * | 4/1984 | Harned | 450/58 |
| 6,755,717 | B2 * | 6/2004 | Smith | 450/1 |
| 7,909,675 | B1 * | 3/2011 | Rainey | 450/59 |

* cited by examiner

*Primary Examiner* — Gloria Hale
(74) *Attorney, Agent, or Firm* — Kaplan Breyer Schwarz & Ottesen

(57) ABSTRACT

A brassiere that can be worn during a mammogram is devoid of metal and has stretch cups. The brassiere permits a woman to remain at least partially clothed above the waist during a mammogram. In various embodiments, the brassiere includes one or more additional features, in any combination, including a compression band, wide shoulder straps, a bra band, and releasable breast cups. Some of the additional features are expected to reduce the pain experienced by some patients undergoing a mammography.

25 Claims, 7 Drawing Sheets

MAMMOGRAPHY BRASSIERE

FIELD OF THE INVENTION

The present invention relates to radiology in general and, more particularly, to a garment for a patient undergoing a mammogram.

BACKGROUND OF THE INVENTION

Finding breast cancer early greatly improves a woman's chances for survival from the disease. Early detection also conserves health-care system resources. A high-quality mammogram and a clinical breast exam done by a doctor are the most effective approaches for early detection.

A mammogram is a low-dose X-ray of the breasts to look for abnormal changes. The results are recorded on film or directly into a computer for a radiologist to read for abnormalities. Breast cancer can be found through a screening mammogram or, in situations in which abnormalities have already been observed, a diagnostic mammogram.

A mammogram is obtained using a mammography unit, such as mammography unit 100 depicted in FIG. 1. The unit includes stand 118, as well as image-acquisition elements, such as an X-ray source, shown generally at 102, collimator 104, compression plate 106, and cassette holder 110.

Collimator 104 restricts the size and shape of the X-ray beam generated by X-ray source 102. Cassette holder 110 houses a removable cassette (not depicted) that includes an image receptor, such as film. The cassette is inserted into holder 110 before each image is taken by mammography unit 100 and is removed thereafter. The film is developed to produce a radiographic image of the breast. Cassette holder 110 has a flat, beam-facing surface or imaging area 112, which is transparent to X-rays. Also in cassette holder 110 is an anti-scatter grid assembly.

Compression plate 106, which comprises a thin, X-ray transparent material, is used to compress the breast to a near uniform thickness against imaging area 112. Adjustment system 108 enables compression plate 106 to be adjusted to provide the requisite amount of compression.

The image-acquisition elements are rotatably coupled to stand 118 via pivot element 114 and coupler 116. The coupler is movable along guide-ways 120 to collectively alter the height of the image-acquisition elements. Pivot element 114 permits the image-acquisition elements to partially collectively rotate in the direction shown with respect to stand 118. This arrangement provides for two projective viewpoints. In particular, the orientation depicted in FIG. 1 provides a head-to-foot or "craniocaudal" (CC) view. In the craniocaudal view, the breast is compressed horizontally and the X-ray is taken in the direction from head to toe. Partial rotation about pivot element 114 from the orientation shown in FIG. 1 provides a mediolateral oblique (MLO) view, wherein the breast is compressed vertically and the X-ray is taken from the side of the breast.

FIG. 2 depicts a simplified view of relevant portions of unit 100 during a mammography. A patient's breast 222 is positioned on the imaging area 112 (FIG. 1) of cassette holder 110 by a radiologic technologist. To image the breast fully, as much of the breast as possible must be positioned between cassette holder 110 and plate 106. Specifically, it is important to capture as much of the "tail" region 226 of the breast as possible between the holder and plate so that it can be radiographically imaged. To accomplish this, the patient is asked to lean forward, which brings the patient's chest wall 224 into tight contact with the rigid forward surfaces and edges of cassette holder 110 and plate 106. Adjustment system 108 enables compression plate 106 to be moved (downward) against the breast, so that the breast is compressed between the compression plate and cassette holder 110.

Compression of the breast can be quite painful for the patient. Furthermore, contact of the chest wall (especially near the axilla) with the edges of compression plate as it is lowered can be an additional source of pain. But compression is essential because it: (1) provides a more uniform thickness of breast tissue, thereby increasing image quality by reducing the thickness of tissue that x-rays must penetrate, (2) spreads out the tissue so that small abnormalities are less likely to be obscured by overlying breast tissue, (3) decreases the amount of scattered radiation, wherein scatter degrades image quality, (4) reduces the required radiation dose since a thinner amount of tissue is being imaged, and (5) immobilizes the breast thereby preventing motion blur.

With continuing reference to FIGS. 1 and 2, X-ray source 102 produces X-ray beam 220. The X-ray beam is passed through collimator 104, which restricts the size and shape of beam 220. The X-ray beam passes through compression plate 106 and through breast 222. A radiological image of the breast is captured on film that is in cassette holder 110.

FIG. 2 depicts a CC view being obtained from the mammography unit. As previously discussed, a MLO view will also be obtained, wherein the image-acquisition elements are rotated about pivot element 114. If the mammography is diagnostic, rather than for screening, additional views may be taken as well.

Notwithstanding its utility for early detection of cancer, many women display an aversion to mammography. Even though the National Cancer Institute recommends that women aged 40 and older should have a screening mammogram every 1-2 years, only 71.8% of women between the ages of 50 and 64 and 72.5% of women ages 65-74 had received a mammogram within the previous 2 years according to 2005 government figures.

There are several reasons why women do not routinely undergo mammography. One reason is cost; those without healthcare coverage are less likely to pay out-of-pocket or seek assistance. An NEJM study found that even a small co-pay of $12 deterred 11% of women from having a mammography. The study also identified time constraints, the cost of transportation, and lost wages as contributing to a lack of screening. A number of hospitals, cancer centers and other healthcare groups have started mobile mammography vans to bring affordable, accessible and convenient mammograms to their communities. Many offer free or low-cost mammograms to women who are uninsured and/or cannot afford a mammogram.

But there are other factors that dissuade women from undergoing a mammogram. A Kaiser Permanente Study published in 2011 cited pain, embarrassment and time as factors that deterred women having health insurance from undergoing screening. As previously mentioned, both breast compression and the accompanying rubbing/pinching of the skin are unpleasant. And with regard to embarrassment, the patient will normally be bare-chested for the mammogram.

There have been attempts in the prior art to address the issue of pain and discomfort with cushioning strips and gel pads that are used in conjunction with the mammography unit. A need remains, however, for a way to decrease the discomfort that accompanies a mammogram and to do it in a way that maintains patient dignity and does not add significantly to the cost of the mammogram unit or the procedure.

SUMMARY OF THE INVENTION

The present invention provides a brassiere (hereinafter "mammography brassiere") that, by virtue of certain physical adaptations, can be worn during a mammogram. The mammography brassiere permits a woman to remain at least partially clothed above the waist during a mammogram. This will lessen feelings of vulnerability and embarrassment that some women experience during the process. In some embodiments, the mammography brassiere additionally incorporates one or more features that are expected to reduce the pain experienced by some patients undergoing a mammography.

In accordance with the invention, embodiments of the mammography brassiere preferably have three defining characteristics, as disclosed below.

Characteristic "1" is the exclusion of any metal from the brassiere (e.g., no metal hooks, etc.). In this regard, a hook-and-loop fastener material (i.e., VELCRO®), plastic, or other suitable non-metallic material is used for closures/adjustments. To the extent that the shoulder straps of the mammography brassiere are adjustable, the adjustment element is located closer to the back band than the cups, which is characteristic "2". That is, when the brassiere is worn, the adjustment element is accessible at the wearer's back. This avoids any interference of the adjustment element with the compression plate, etc. Characteristic "3" is that the cups of the mammography brassiere are formed of a material that provides very little resistance to deformation (by the mammography unit), such as stretchable nylon or Lycra (i.e., spandex) netting.

In addition to possessing one or more, and preferably all of characteristics (1) through (3) discussed above, some embodiments of the mammography brassiere will include one or more of the following features (a) through (d) disclosed below.

In some embodiments, a mammography brassiere in accordance with the invention includes feature (a), which is a compression band. The compression band encircles the upper torso of the wearer just above the breasts. In some embodiments, the compression band couples to the shoulder straps of the brassiere. The compression band compresses the wearer's chest at the junction between the uppermost portion or "tail" of the breast and the chest wall; that is, just above the region 226 depicted in FIG. 2. This has the effect of forcing the breasts, in particular the region of the breasts closest to the chest wall, forward. This facilitates positioning a breast between compression plate 106 and cassette holder 110 of mammography unit 100 as required during a mammogram. It is believed that the pre-compression provided by the compression band may reduce some of the discomfort that is experienced during breast-positioning and compression that accompanies a mammography.

In some embodiments, a mammography brassiere in accordance with the invention includes feature (b), which are very wide shoulder straps. At the shoulders, the straps are at least about 4 centimeters wide and increase in width as the straps descend towards the cups. The wide straps comprise a material that provides a relatively low-friction surface relative to skin. With reference to FIG. 2, this surface promotes sliding movement of forward edge 107 of compression plate 106 down the patient's chest wall during positioning of the compression plate, thereby reducing any pinching/pulling of the skin that might otherwise occur.

In some embodiments, a mammography brassiere in accordance with the invention includes feature (c), which is a band that compresses and/or laterally shifts the position of the contralateral breast. The band, which is relatively short, is removable and is moved to either breast cup as a function of which breast is not being radiographed. One end of the band (hereinafter "cup band") attaches, e.g., via hook-and-loop fastener, etc., between the two cups, or on each cup toward the medial edge thereof, and the other end attaches in the same manner along the side panel or bra band of the brassiere.

In some embodiments, a mammography brassiere in accordance with the invention includes feature (d), which are breast cups that are partially releasable or detachable. Partially releasing the cup that receives the contralateral breast causes that breast to be become unsupported by the brassiere. This facilitates set-up operations for the breast that is being radiographed and allows the contralateral breast to be easily positioned out of the radiation field. The contralateral breast remains at least somewhat covered by the released cup during set-up and radiography of the other breast.

With respect to feature (d), in some of such embodiments, each cup is permanently attached to a complementary shoulder strap but is releasably coupled to the bra band by hook-and-loop fastener, etc. In some other of such embodiments, the breast cups of the mammography brassiere are not coupled directly to one another (e.g., via a center panel, etc.). Rather, each cup is attached at a superior edge to a shoulder strap, at a lateral edge to a bra band, and at a medial edge to a strap that wraps partially around the wearer's torso and releasably couples to the bra band at the back of the wearer. This "medial strap" releasably couples to the bra band via, for example, hook-and-loop fastener.

In summary, in addition to preferably possessing characteristics (1) through (3), some embodiments of a mammography brassiere in accordance with the present invention include one or more of the features (a) through (d), in any combination. An embodiment of the brassiere would not typically include both features (c) and (d). Table I is a list of the characteristics and features of some preferred embodiments of a mammography brassiere in accordance with the present invention. In the Table, a "✓" indicates that the particular characteristic or feature is associated with the particular embodiment.

TABLE I

List of the Characteristics and Features of Some Preferred Embodiments

| | CHARACTERISTICS/FEATURES | | | | | | |
|---|---|---|---|---|---|---|---|
| Embodiment | No Metal | Back Adjustment Shoulder Strap | Stretch Cup | Compression Band | Wide Shoulder Straps | Cup Band | Releasable Cups |
| 1 | ✓ | ✓ | ✓ | — | — | — | — |
| 2 | ✓ | ✓ | ✓ | ✓ | — | — | — |
| 3 | ✓ | ✓ | ✓ | — | ✓ | — | — |
| 4 | ✓ | ✓ | ✓ | — | — | ✓ | — |
| 5 | ✓ | ✓ | ✓ | — | — | — | ✓ |
| 6 | ✓ | ✓ | ✓ | ✓ | ✓ | — | — |

TABLE I-continued

List of the Characteristics and Features of Some Preferred Embodiments

| | CHARACTERISTICS/FEATURES | | | | | | |
|---|---|---|---|---|---|---|---|
| Embodiment | No Metal | Back Adjustment Shoulder Strap | Stretch Cup | Compression Band | Wide Shoulder Straps | Cup Band | Releasable Cups |
| 7 | ✓ | ✓ | ✓ | ✓ | — | — | ✓ |
| 8 | ✓ | ✓ | ✓ | — | ✓ | — | ✓ |
| 9 | ✓ | ✓ | ✓ | ✓ | ✓ | — | ✓ |
| 10 | ✓ | ✓ | ✓ | ✓ | — | ✓ | — |
| 11 | ✓ | — | ✓ | ✓ | — | — | — |
| 12 | ✓ | — | ✓ | — | ✓ | — | — |
| 13 | ✓ | — | ✓ | ✓ | ✓ | — | — |
| 14 | ✓ | — | ✓ | ✓ | — | — | ✓ |
| 15 | ✓ | — | ✓ | — | ✓ | — | ✓ |
| 16 | ✓ | — | ✓ | ✓ | ✓ | — | ✓ |

DETAILED DESCRIPTION

A number of embodiments of a mammography brassiere in accordance with the present invention are described herein. All such embodiments are preferably, but not necessarily, associated with three defining characteristics. First, for all such embodiments, it is preferable that no metal is included in the bra, such as is typically embodied in an underwire, closure hooks, etc. If present, metal can scatter, block, or otherwise interfere with the x-rays emitted from the mammography unit. Second, to the extent that the shoulder straps of the various embodiments of the mammography brassiere include an adjustment device for changing the length of the straps, it should be accessible at the back of the wearer not the front, so as not to interfere with the breast-positioning elements of the mammography unit. Third, the breast cups of the various embodiments of the mammography brassiere should be "stretch cups," which will provide very little resistance to deformation during applied force, such as the compression force applied by the compression plate of a mammography unit.

Figure 1:
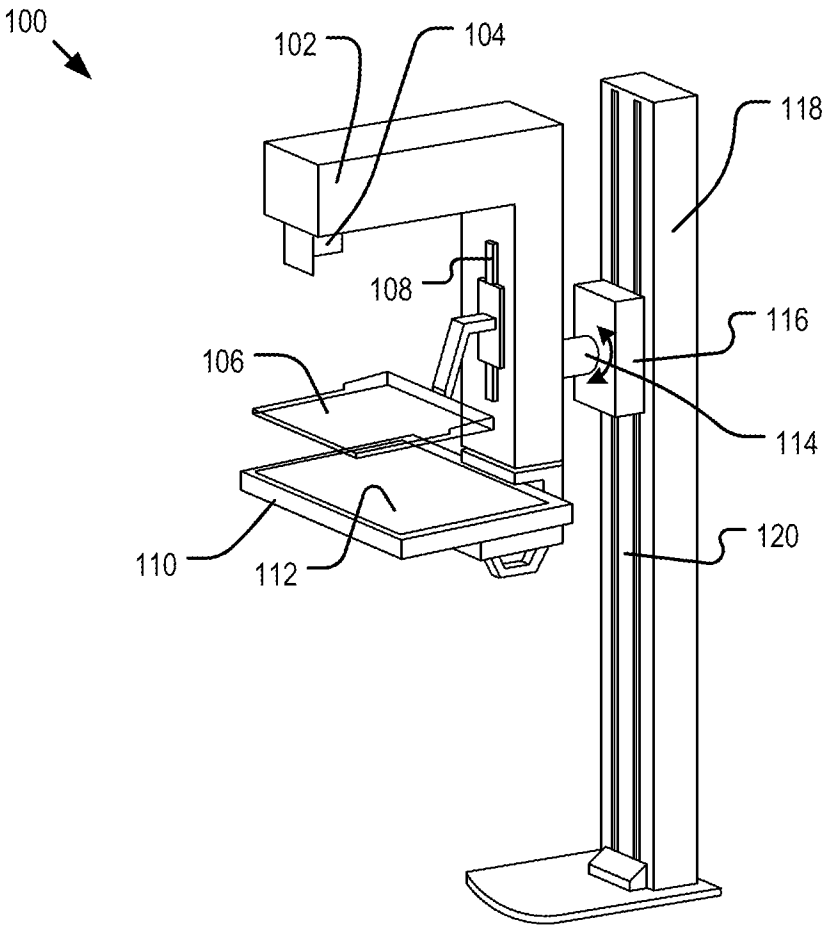
FIG. 1 Prior Art
FIG. 1 depicts mammography unit 100 in the prior art.
Figure 2:
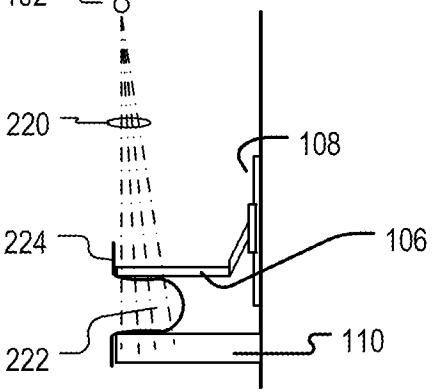
FIG. 2 Prior Art
FIG. 2 depicts a simplified view of mammography unit 100 in operation.
Figure 3B:
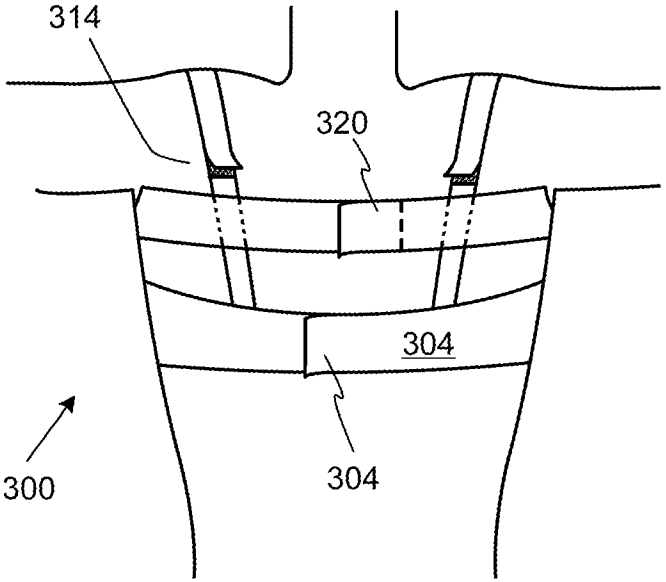
FIGS. 3A and 3B depict mammography brassiere 300 in accordance with an embodiment of the present invention.
Figure 3A:
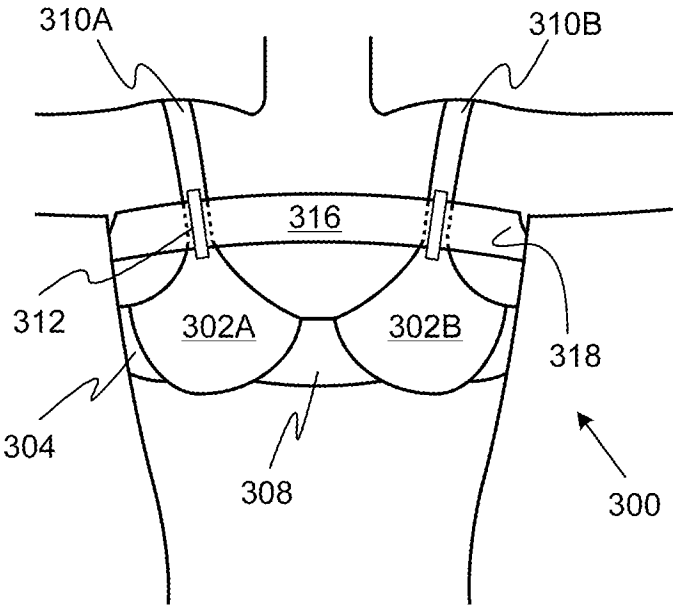

FIGS. 3A and 3B depict respective front and back views of mammography brassiere 300 (on a wearer) in accordance with the present invention. Brassiere 300 includes breast cups 302A and 302B, bra band 304, center panel 308, shoulder straps 310A and 310B, and compression band 316.

Breast cups 302A and 302B receive the wearer's breasts. As previously mentioned, the breast cups are stretch cups. For use herein and the appended claims, the term "stretch cups" means that the cups are formed in such a way (materials selection and/or fabric weave) that they provide little shaping to the breasts and provide very little resistance to deformation during applied force (e.g., compression, etc.). Materials suitable for use as cups 302A and 302B include, without limitation, stretchable nylon, LYCRA® brand spandex netting, or other fabrics known to those skilled in the art having an appropriate weave and/or thread type. The cups preferably, but not necessarily, comprise a four-way stretch fabric.

Cups 302A and 302B attach, at their respective lateral edges, to bra band 304. The bra band comprises a resilient, elastic material, such as, without limitation, LYCRA® brand spandex fiber or girdle fabric (i.e., two-way stretch nylon fabric). In mammography brassiere 300, the bra band stops at the lateral edges of cups 302A and 302B, wherein center panel or "gore" 308 is disposed between the cups, attaching to the respective medial edges thereof. In some other embodiments, the bra band is a single continuous piece that encircles the wearer's torso (see, e.g., FIGS. 5A and 5B; mammography brassiere 500).

Bra band 304 includes back closure 306, which is implemented in some embodiments as complementary strips of hook-and-loop fastener material (VELCRO®) that are attached to the free ends of the bra band. As used herein and in the appended claims, the term "back closure" refers to a closure that is located at the back of a wearer of the brassiere. Similarly, as used herein and in the appended claims, when the term "back" is used to reference a portion of the brassiere, such as the "back" of the bra band, it means that the referenced portion is located at the back of the wearer of the brassiere.

Cups 302A and 302B attach, at their respective superior edges, to "front" end of respective shoulder straps 310A and 310B. The straps of mammography brassiere 300 attach camisole-strap style to bra band 304 wherein the "back" end of shoulder straps 310A and 310B are sewn to the bra band at approximately a right angle thereto. In some other embodiments (not depicted), the straps can attach leotard-strap style to bra band 304.

Shoulder straps 310A and 310B can be made of cotton, LYCRA® brand spandex fiber, or other materials known to those skilled in the art. It is preferable that the outward-facing surface (as opposed to the surface that abuts the skin of the wearer, hereinafter referred to as the "inward-facing surface")

of shoulder straps 310A and 310B is characterized by relatively low friction, so that the compression plate of a mammography unit will slide relatively unimpeded over the shoulder straps. In some further embodiments, shoulder straps 310A and 310B comprise a clear thermoplastic material, such as Clear-Fit TPU brand thermoplastic polyurethane, commercially available from Fulflex, Inc. of Brattleboro, Vt.

Each shoulder strap 310A and 310B includes an adjustment element 314 that is accessible at the wearer's back for adjusting the effective length of the shoulder straps. In the illustrative embodiment, each strap includes two portions, wherein one portion of the strap attaches to the superior edge of a breast cup and the other portion of the strap attaches to bra band 304. In mammography brassiere 300, the adjustment element 314 comprises complementary strips of hook-and-loop fastener material (i.e., VELCRO®) that are attached to the free ends of the two strap portions. In such an embodiment, the fastener material enables the two portions to be coupled; the amount by which the portions overlap one another dictates the effective length of the strap. In some other embodiments (not depicted), adjustment feature 314 comprises non-metallic (e.g., plastic, etc.) rings on each strap to alter the length thereof.

Brassiere 300 also includes compression band 316. Compression band 316 is similar in structure to a breast band disclosed in co-pending U.S. patent application Ser. No. 13/411,312 and is virtually identical to a breast band disclosed in Ser. No. 13/439,021, both of which are incorporated herein by reference.

Compression band 316 provides two axilla-accommodating regions 318, which prevent the band from creasing or folding over and decreases the tendency for the band to press into the wearer's skin at the axilla regions. In Ser. No. 13/411,312, the breast band was covered, in at least some embodiments, with a soft, moisture absorbent material. In contrast, the outer surface of compression band 316 present a smooth, low-friction surface to the mammography unit's compression plate so that the compression will readily slide over the compression band during breast positioning. A material suitable for use as the compression band is the aformentioned Clear-Fit TPU brand thermoplastic polyurethane. U.S. patent application Ser. No. 13/439,021 discloses an embodiment in which the breast band comprises TPU thermoplastic polyurethane. Compression band 316 includes a closure/adjustment element 320. In the illustrative embodiment, closure/adjustment element comprises hook-and-loop fastener material (VELCRO®), which is attached to the free ends of compression band 316.

Each shoulder strap 310A and 310B of mammography brassiere 300 is physically adapted to receive compression band 316 and ensure that it remains in position as the mammography unit compression plate slides over the compression band. In brassiere 300, the physical adaptation is coupling element 312, which is configured as a loop of material. The material advantageously provides a low-friction surface, and can be, without limitation, polyester. In some other embodiments (not depicted), coupling element 312 is a slit that is long enough to accommodate the width of compression band 316, such that the compression band passes through each shoulder strap 310A and 310B.

In some alternative embodiments, shoulder straps 310A and 310B are not adapted to receive compression band 316 and the band is not otherwise attached to other parts of brassiere 300. In such embodiments, the mammography brassiere is a two-piece system: the brassiere proper and the compression band. In some such embodiments, the skin-facing surface of compression band 316 comprises a relatively higher friction surface than the outward facing surface thereof. The higher friction surface reduces the tendency of compression band 316 to slide over the wearer's skin. When embodied as a two-piece system, compression band 316 can be worn under or over the shoulder straps.

Figure 4B:
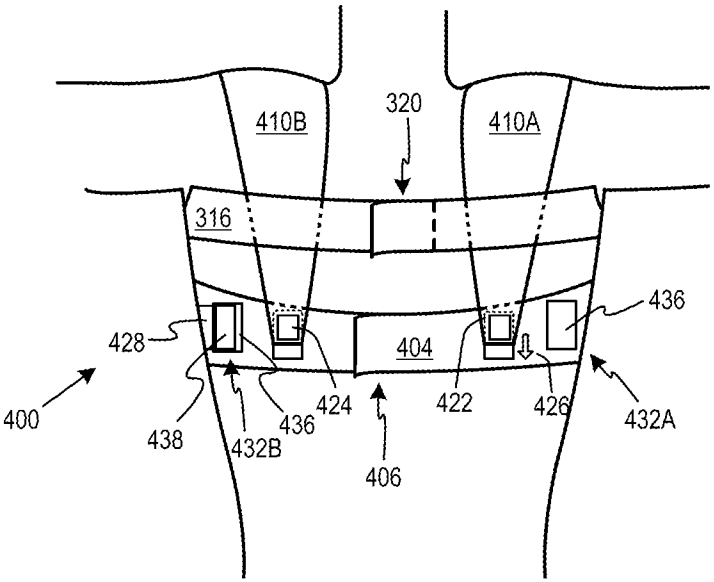
FIGS. 4A and 4B depict mammography brassiere 400 in accordance with an embodiment of the present invention.
Figure 4C:
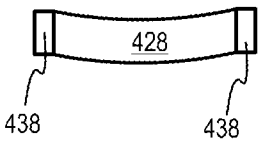
FIG. 4C depicts a cup strap for use with mammography brassiere 400.
Figure 4A:
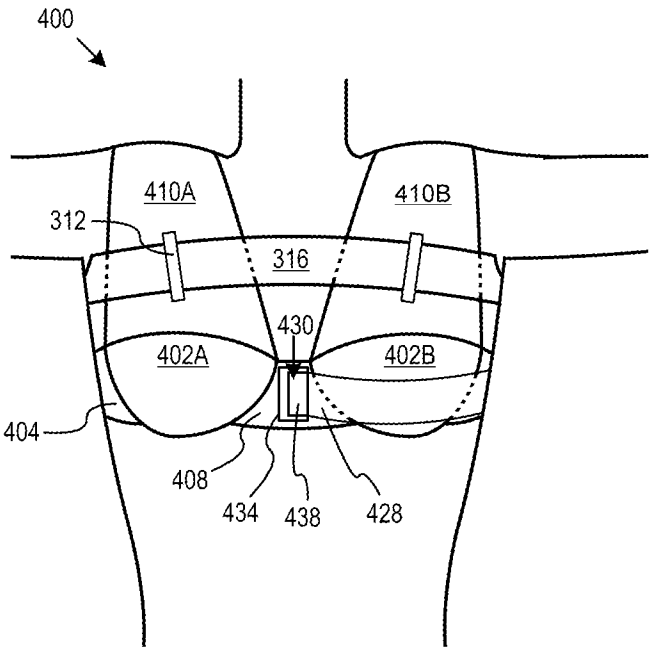

FIGS. 4A and 4B depict respective front and back views of mammography brassiere 400 (on a wearer) in accordance with the present invention. Brassiere 400 includes breast cups 402A and 402B, bra band 404 and back closure 406, center panel 408, shoulder straps 410A and 410B, compression band 316 and closure/adjustment feature 320, and cup band 428.

Shoulder straps 410A and 410B of mammography brassiere 400 are wider than shoulder straps 310A and 310B. The relatively wider shoulder straps of brassiere 400 reduce the amount of contact between the mammography unit's compression plate and the skin of the patient's upper chest as compared to the relatively thinner shoulder straps of brassiere 300. At the shoulders, shoulder straps 410A and 410B have a width in the range of about 4 to 8 centimeters. Like shoulder straps 310A and 310B of brassiere 300, shoulder straps 410A and 410B including coupling element 312 for coupling compression band 316 to the shoulder straps. Shoulder straps 410A and 410B can be made of the same material as shoulder straps 310A and 310B.

The wider shoulder straps of brassiere 400 are coupled to bra band 404 in a different manner than shoulder straps 310A and 310B of brassiere 300. In particular, shoulder straps 410A and 410B attach to bra band 404 via strips of hook-and-loop fastener material (VELCRO®) at back closure/adjustment feature 414. For example, two (relatively longer) strips 422 of fastener material are disposed on bra band 404 and positioned to engage two (relatively shorter) strips 424 of fastener material disposed at the free end of the shoulder straps (one strip on each strap). This enables shoulder straps 410A and 410B to couple to bra band 404; the precise positioning of the shoulder strap vis-à-vis the bra band dictates the effective length of the strap. That is, a shoulder strap 410A or 410B is effectively shortened by positioning the free end of the shoulder strap further toward the inferior (lower) edge of bra band 404, as indicated by arrow 426.

Cup band 428, depicted in FIG. 4C as well as FIGS. 4A and 4B, is a strip of material that is long enough (e.g., approximately 10-12 inches) to extend from center panel 408 to somewhat beyond the lateral edge of breast cup 402A or 402B. The cup band comprises a material that can be, but need not be, resilient. For example, in some embodiments, the material can be LYCRA® brand spandex, cotton, or other materials known in the construction of brassieres. Cup band 428 attaches to brassiere 400 at two locations for each cup. One location is medial attachment point 430, which is disposed in center panel 408. The second location is, for right cup 402A, right-side lateral attachment point 432A. For left cup 402B, the second attachment location is left-side lateral attachment point 432B. The lateral attachment points are located proximal to the lateral edge of each breast cup 402A and 402B.

Strip 434 of hook-and-loop fastener material is disposed at medial attachment point 430. Strip 436 of hook-and-loop fastener material is disposed at each of the left-side and right-side lateral attachment points 432. Strips 438 of hook-and-loop fastener material are disposed at the free ends of cup band 428.

In use, if the right breast is being prepared for a mammogram, cup band 428 is used to move the left breast "out of the way" by somewhat compressing it and/or pulling it laterally (i.e., toward left-side lateral attachment point 432B). To do this, strip 438 of hook-and-loop fastener at one end of cup band 428 is coupled to complementary strip 434 of hook-and-loop fastener disposed at medial attachment point 430. Cup band 428 is then pulled tight against the left breast and strip 438 of hook-and-loop fastener at the other end of the cup band is coupled to complementary strip 436 disposed at left-side lateral attachment point 432B. Conversely, if the left breast is being prepared for a mammogram, cup band 428 is used to move the right breast out of the way. The process is the same, but now applied to the right breast, such that one end of cup band 428 couples to medial attachment point 430 and the other end attaches to right-side lateral attachment point 432A.

In some alternative embodiments, rather than having a single medial attachment point 430 that is disposed between cups 402A, a medial attachment point is located on each cup, toward the medial edge of the cup.

Figure 5B:
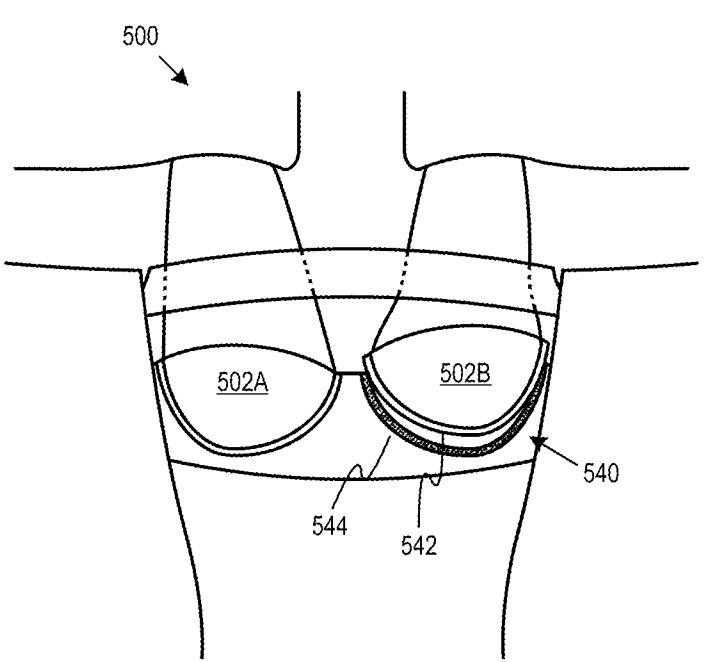
FIGS. 5A and 5B depict mammography brassiere 500 in accordance with an embodiment of the present invention.
Figure 5A:
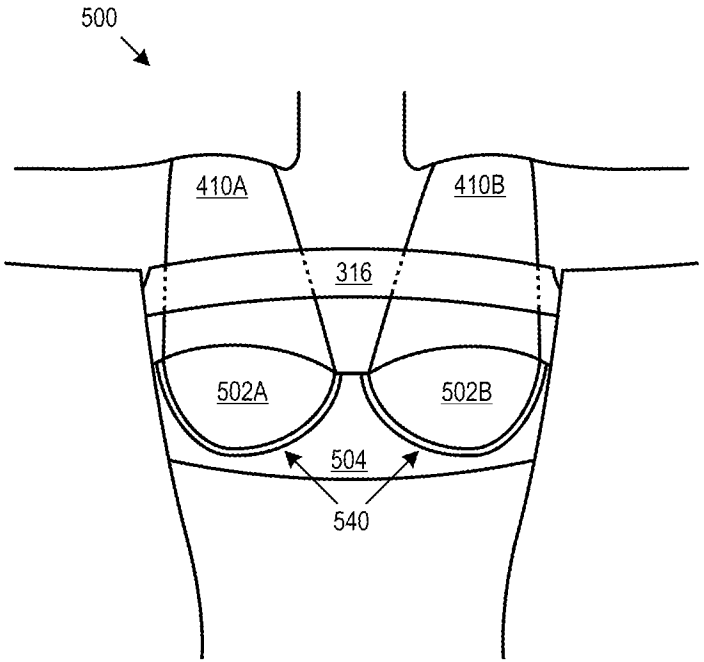

FIGS. 5A and 5B depict front views of mammography brassiere 500 (on a wearer) in accordance with the present invention. Brassiere 500 includes releasable breast cups 502A and 502B, bra band 504, shoulder straps 510A and 510B, and compression band 316.

Brassiere 500 includes wide shoulder straps 510A and 510B like those of brassiere 400, but without coupling element 312 that couples compression band 316 to the shoulder straps. Compression band 316 can still be used with brassiere 500; the compression band is simply not coupled to other elements of the brassiere 500.

Unlike brassieres 300 and 400, mammography brassiere 500 has releasable cups, wherein breast cups 502A and 502B are individually releasable from bra band 504 via closures 540.

FIG. 5B depicts cup 502B released from bra band 504. In this embodiment, closure 540 comprises complementary strips 542 and 544 of hook-and-loop fastener. Strip 542 is attached to the periphery of each cup 502A and 502B. Strips 544 are attached to the superior edge of front of bra band 504 at two locations and are positioned to couple to strips 542 of hook-and-loop fastener on the cups when the cups are brought into contact with the bra band. As depicted in FIG. 5B, the superior edge of bra band 504 is contoured to follow the curve of cups 502A and 502B.

The materials of construction for various elements (e.g., shoulder straps, bra band, cups, etc.) of brassiere 500 are the same as indicated for brassieres 300 and 400.

Figure 6B:
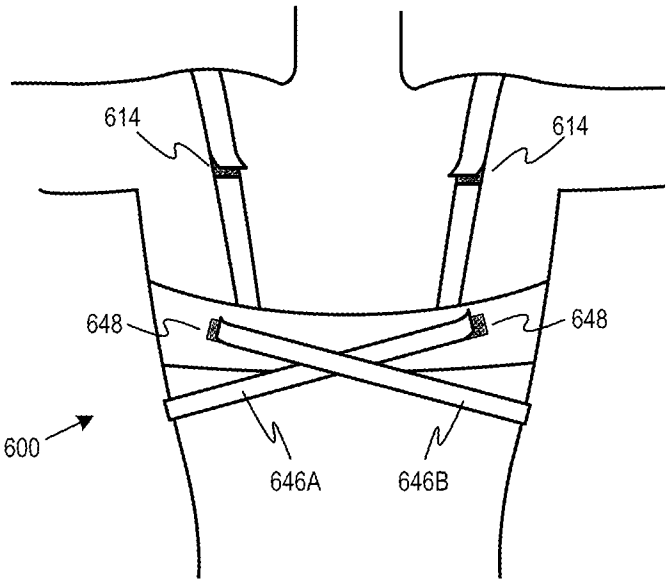
FIGS. 6A and 6B depict mammography brassiere 600 in accordance with an embodiment of the present invention.
Figure 6A:
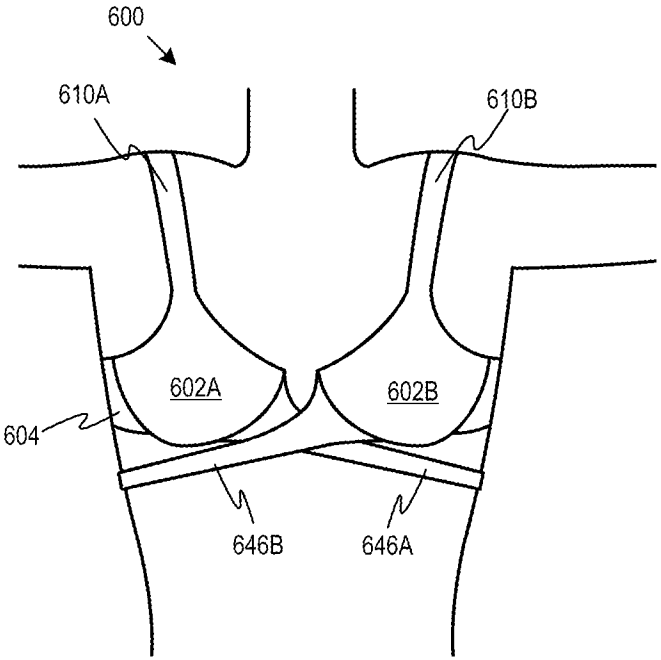

FIGS. 6A and 6B depict respective front and back views of mammography brassiere 600 (on a wearer) in accordance with the present invention. Brassiere 600 includes releasable breast cups 602A and 602B, medial straps 646A and 646B, bra band 604, and shoulder straps 610A and 610B.

Like brassiere 500, brassiere 600 includes individually releasable breast cups, but implements the release function differently. Brassiere 600 lacks a central panel or a continuous bra band that would otherwise effectively couple cups 602A and 602B to one another. Rather, the medial edge of each cup couples, via a medial strap, to the bra band at the back of the wearer.

Specifically, medial strap 646A attaches to the medial edge of cup 602A and medial strap 646B attaches to the medial edge of cup 602B. The medial straps then wrap partially about the torso of the wearer, coupling to bra band 604 at closures 648. In brassiere 600, closures 648 are embodied as hook-and-look fastener.

In use, if the right breast is being prepared for a mammogram, medial strap 646B is released from closure 648, which releases cup 602B. This facilitates the positioning of the right breast in the mammography unit without interference from the left breast. Conversely, if the left breast is being prepared for a mammogram, medial strap 646A is released from closure 648, thereby releasing cup 602A. A released cup will provide coverage of the breast.

Brassiere 600 is used without compression band 316. Shoulder strap 610A and 610B are similar to shoulder straps 310A and 310B of brassiere 300, and includes adjustment element that is accessible at the wearer's back for adjusting the length of the shoulder straps. The adjustment element can be hook-and-loop fastener, non-metallic rings, etc.

The materials of construction for various elements (e.g., shoulder straps, bra band, cups, etc.) of brassiere 600 are the same as indicated for brassieres 300 through 500.

Figure 7B:
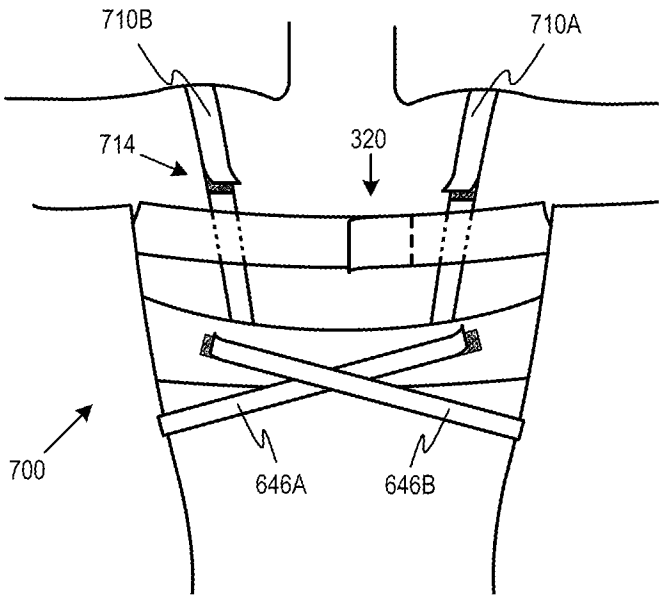
FIGS. 7A and 7B depict mammography brassiere 700 in accordance with an embodiment of the present invention.
Figure 7A:
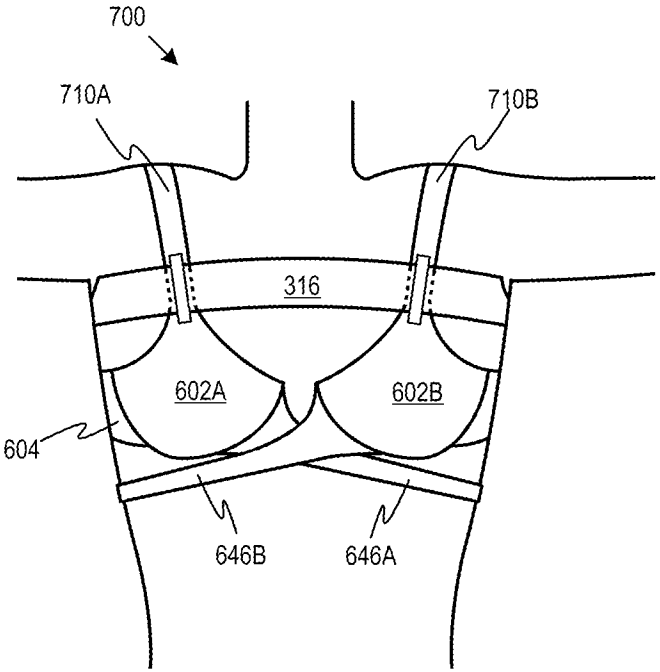

FIGS. 7A and 7B depict respective front and back views of mammography brassiere 700 (on a wearer) in accordance with the present invention. Brassiere 700 is a version of brassiere 600 that includes a compression band. Brassiere 700 comprises releasable breast cups 602A and 602B, medial straps 646A and 646B, bra band 604, compression band 316 and closure/adjustment element 320, and shoulder straps 710A and 710B with adjustment element 714.

The materials of construction for various elements (e.g., shoulder straps, bra band, cups, etc.) of brassiere 700 are the same as indicated for brassieres 300 through 600.

Figure 8B:
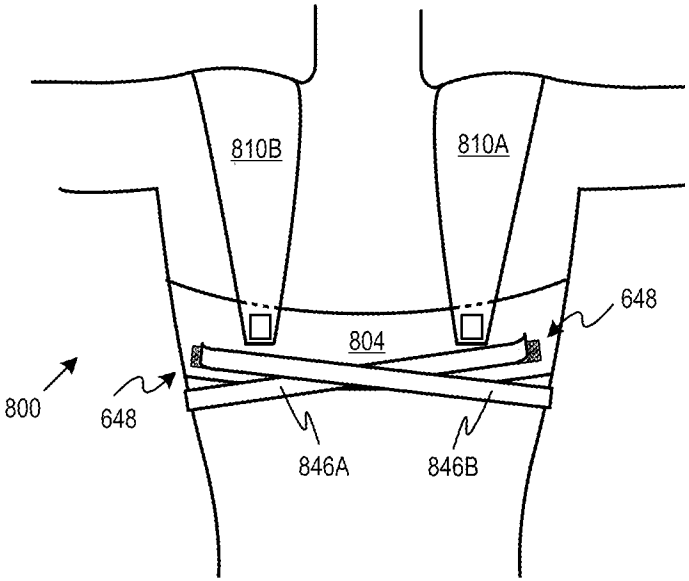
FIGS. 8A and 8B depict mammography brassiere 700 in accordance with an embodiment of the present invention.
Figure 8A:
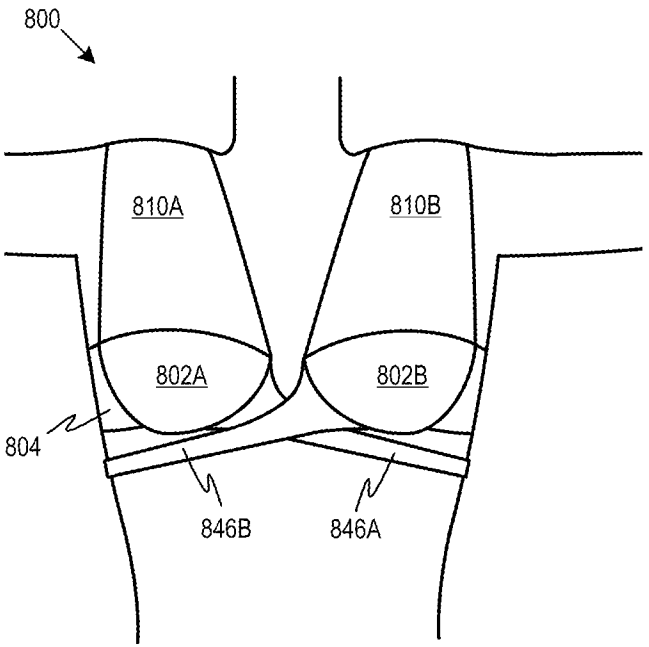

FIGS. 8A and 8B depict respective front and back views of mammography brassiere 800 (on a wearer) in accordance with the present invention. Brassiere 800 includes releasable breast cups 802A and 802B, medial straps 846A and 846B, bra band 804, and shoulder straps 810A and 810B with back closure/adjustment feature 814.

Brassiere 800 includes releasable breast cups that are similar to those in brassieres 600 and 700 and the relatively wider shoulder straps of brassiere 400. The operation of brassiere 800 is the same as brassiere 600 in terms of releasing the cup of the non-involved breast by releasing the appropriate medial strap 846A or 846B from the appropriate closure 648.

The materials of construction for various elements (e.g., shoulder straps, bra band, cups, etc.) of brassiere 800 are the same as indicated for brassieres 300 through 700.

It is to be understood that many variations of the invention can easily be devised by those skilled in the art after reading this disclosure and that the scope of the present invention is to be determined by the following claims.

What is claimed is:

1. A brassiere comprising:

two stretch cups;

a bra band and two shoulder straps for supporting the two stretch cups; and a compression band, wherein the compression band circumferentially encircles an upper chest of a wearer and compresses the upper chest at a function between an uppermost portion of the wearer's breasts and chest wall, leaving all remaining portion of the breasts uncompressed by the compression band, and wherein the compression band includes an adjustable closure that opens and closes the band;

and further wherein the brassiere is devoid of metal.

2. The brassiere of claim 1 wherein at least one shoulder strap comprises a coupling element for coupling the compression band to the shoulder strap.

3. The brassiere of claim 1 wherein each shoulder strap comprises an adjustment element that is accessible at a wearer's back for adjusting an effective length of each shoulder strap.

4. The brassiere of claim 1 wherein the compression band comprises first and second axilla-accommodating regions, wherein a width of the compression band on both sides of the first and second axilla-accommodating regions is greater than the width of the compression band in the axilla-accommodating regions, the axilla-accommodating regions thereby defining two discrete regions of relatively reduced width with respect to the rest of the compression band, and wherein when the compression band is worn, the first and second axilla-accommodating regions are positioned below each axilla of the wearer.

5. The brassiere of claim 1 wherein at least one of the compression band and the shoulder straps comprises thermoplastic polyurethane.

6. The brassiere of claim 1 wherein an outward-facing surface of the compression band comprises a lower-friction surface than the wearer's skin.

7. The brassiere of claim 1 wherein the shoulder straps are at least 4 centimeters wide at the shoulders of the wearer.

8. The brassiere of claim 7 wherein one end of each shoulder strap removably couples to the bra band.

9. The brassiere of claim 1 further comprising a cup band that couples to the brassiere at either (i) a medial attachment point disposed between the two stretch cups and a right-side lateral attachment point that is disposed beyond a lateral edge of the right stretch cup or (ii) the medial attachment point and a left-side lateral attachment point that is disposed beyond a lateral edge of the left stretch cup.

10. The brassiere of claim 1 wherein the two stretch cups are independently releasable from a portion of the brassiere.

11. The brassiere of claim 10 further comprising closures that couple each stretch cup to a front of the bra band.

12. The brassiere of claim 11 wherein the closures comprise hook-and-loop fastener.

13. The brassiere of claim 10 wherein the bra band terminates at a lateral edge of each stretch cup, and further comprising a medial strap that attaches to a medial edge of each stretch cup and releasably couples to a closure disposed at the back of the bra band.

14. A brassiere comprising:

two stretch cups that are independently releasable from a portion of the brassiere;

a bra band and two shoulder straps for supporting the two stretch cups, wherein the outward facing surface of the shoulder straps comprises a lower-friction surface than the wearer's skin; and a compression band comprises first and second axilla-accommodating regions, wherein a width of the compression band on both sides of the first and second axilla-accommodating regions is greater than the width of the compression band in the axilla-accommodating regions, the axilla-accommodating regions thereby defining two discrete regions of relatively reduced width with respect to the rest of the compression band, and wherein when the compression band is worn, the first and second axilla-accommodating regions are positioned below each axilla of the wearer.

15. The brassiere of claim 14 wherein an outward facing surface of the compression band comprises a lower-friction surface than the wearer's skin.

16. The brassiere of claim 15 wherein at least one of the compression band and the shoulder straps comprises thermoplastic polyurethane.

17. The brassiere of claim 15 further comprising closures that couple each stretch cup to a front of the bra band.

18. A brassiere comprising:

two stretch cups;

a bra band and two shoulder straps for supporting the two stretch cups;

closures that couple each stretch cup to a front of the bra band;

a compression band, wherein the compression band circumferentially encircles an upper chest of a wearer just above the breasts and wherein the compression band includes an adjustable closure that opens and closes the band;

and further wherein the brassiere is devoid of metal.

19. The brassiere of claim 18 wherein the two stretch cups are independently releasable from a portion of the brassiere.

20. The brassiere of claim 18 wherein at least one of (i) the two shoulder straps and (ii) the compression band has an outward facing surface that comprises a lower-friction surface than the wearer's skin.

21. The brassiere of claim 18 wherein at least one of (i) the two shoulder straps and (ii) the compression band comprises thermoplastic polyurethane.

22. A brassiere comprising:

two stretch cups;

a bra band and two shoulder straps for supporting the two stretch cups, wherein each shoulder strap comprises an adjustment element that is accessible at a wearer's back for adjusting an effective length of each shoulder strap; and a compression band, wherein the compression band circumferentially encircles an upper chest of a wearer, and wherein the compression band includes an adjustable closure that opens and closes the band;

and further wherein the brassiere is devoid of metal.

23. The brassiere of claim 22 wherein at least one of (i) the two shoulder straps and (ii) the compression band has an outward facing surface that comprises a lower-friction surface than the wearer's skin.

24. The brassiere of claim 22 wherein at least one of (i) the two shoulder straps and (ii) the compression band comprises thermoplastic polyurethane.

25. A brassiere comprising:

two stretch cups; and a bra band and two shoulder straps for supporting the two stretch cups; and a compression band, wherein the compression band circumferentially encircles an upper chest of a wearer, and wherein at least one of the compression band and the shoulder straps comprises thermoplastic polyurethane;

and further wherein the brassiere is devoid of metal.

* * * * *